US011548834B2

(12) United States Patent
Mendenhall et al.

(10) Patent No.: US 11,548,834 B2
(45) Date of Patent: Jan. 10, 2023

(54) GAS GENERANT COMPOSITIONS COMPRISING A THERMALLY STABLE CRYSTALLINE HYDRATE COMPOUND FOR COOLING COMBUSTION FLAME TEMPERATURE AND IMPROVING BALLISTIC PERFORMANCE

(71) Applicant: AUTOLIV ASP, INC., Ogden, UT (US)

(72) Inventors: Ivan V. Mendenhall, Providence, UT (US); Gary K. Lund, Malad City, ID (US)

(73) Assignee: Autoliv ASP, Inc., Ogden, UT (US)

( * ) Notice: Subject to any disclaimer, the term of this patent is extended or adjusted under 35 U.S.C. 154(b) by 957 days.

(21) Appl. No.: 16/369,591

(22) Filed: Mar. 29, 2019

(65) Prior Publication Data

US 2020/0308078 A1 Oct. 1, 2020

(51) Int. Cl.

| | |
|---|---|
| ***C06B 25/34*** | (2006.01) |
| ***C06B 23/04*** | (2006.01) |
| ***C06B 41/00*** | (2006.01) |
| ***C06D 5/06*** | (2006.01) |

(52) U.S. Cl.

CPC ..... *C06B 25/34* (2013.01); *C06B 23/04* (2013.01); *C06B 41/00* (2013.01); *C06D 5/06* (2013.01)

(58) Field of Classification Search

None

See application file for complete search history.

(56) References Cited

U.S. PATENT DOCUMENTS

| | | | | |
|---|---|---|---|---|
| 2,769,731 | A * | 11/1956 | Schneid | C07F 3/003 427/389.9 |
| 3,473,981 | A | 10/1969 | Butts et al. | |
| 3,862,866 | A | 1/1975 | Timmerman et al. | |
| 4,099,376 | A * | 7/1978 | Japs | C06B 29/22 60/39.47 |
| 6,039,820 | A | 3/2000 | Hinshaw et al. | |
| 6,051,158 | A | 4/2000 | Taylor et al. | |
| 6,241,281 | B1 | 6/2001 | Hinshaw et al. | |
| 6,602,365 | B1 | 8/2003 | Mendenhall | |
| 6,958,101 | B2 | 10/2005 | Mendenhall et al. | |
| 8,231,747 | B2 | 7/2012 | Mendenhall et al. | |
| 2003/0089883 | A1 | 5/2003 | Knowlton et al. | |
| 2003/0094225 | A1 * | 5/2003 | Knowlton | C06B 23/009 149/45 |
| 2004/0231767 | A1 | 11/2004 | Mendenhall et al. | |
| 2005/0127324 | A1 * | 6/2005 | Wu | C06B 23/04 252/181.3 |
| 2007/0131900 | A1 | 6/2007 | Wu | |
| 2011/0025030 | A1 | 2/2011 | Mendenhall et al. | |
| 2013/0139935 | A1 | 6/2013 | Baggett, Jr. et al. | |
| 2014/0261927 | A1 | 9/2014 | Mendenhall et al. | |
| 2015/0183930 | A1 * | 7/2015 | Hsueh | C08K 7/14 524/502 |
| 2017/0218178 | A1 | 8/2017 | Akahira et al. | |
| 2020/0308077 | A1 | 10/2020 | Mendenhall et al. | |
| 2020/0308079 | A1 | 10/2020 | Mendenhall et al. | |

FOREIGN PATENT DOCUMENTS

| | | | |
|---|---|---|---|
| EP | 3000799 | A1 | 3/2016 |
| GB | 2200915 | A | 8/1988 |
| JP | 2006076832 | A | 3/2006 |
| JP | 2006290699 | A | 10/2006 |
| JP | 2008260658 | A | 10/2008 |
| RU | 2247700 | C2 | 3/2005 |

OTHER PUBLICATIONS

Structural and comparative electrochemical study of M(II) oxalates, M=Mn, Fe, Co, Ni, Cu, Zn, Maria C.LópezJ.L.TiradoC.Pérez Vicente, Journal of Power Sources vol. 227, Apr. 1, 2013, pp. 65-71 (Year: 2013).*

Mendenhall, Ivan V. et al., U.S. Appl. No. 16/369,577, filed Mar. 29, 2019 entitled, "Gas Generant Compositions Comprising Melamine Oxalate for Use in Automotive Restraint Devices," 38 pages.

Mendenhall, Ivan V. et al., U.S. Appl. No. 16/369,609, filed Mar. 29, 2019 entitled, "Cool Burning Hydrate Fuels in Gas Generant Formulations for Automotive Airbag Applications," 43 pages.

International Search Report and Written Opinion for International Application No. PCT/US2020/017584 dated Jun. 16, 2020, 10 pages (ISA/EP).

International Search Report and Written Opinion for International Application No. PCT/US2020/017591 dated May 28, 2020, 11 pages (ISA/EP).

International Search Report and Written Opinion for International Patent Application No. PCT/US2020/017595, dated Jul. 1, 2020, 13 pages (ISA/EP).

Crystal structure of the copper complex with cyanuric acid Cu(C3H2N303)2(H20)2 Author Chang-Zhang Chen Chen, Chang-Zhang (Year: 1995).

* cited by examiner

*Primary Examiner* — Aileen B Felton

(74) *Attorney, Agent, or Firm* — Harness, Dickey & Pierce, P.L.C.; Stephen T. Olson

(57) ABSTRACT

A gas generant composition for an automotive inflatable restraint system is provided with a fuel having a thermally stable crystalline hydrate compound with a water release temperature of greater than or equal to about 140° C. The thermally stable crystalline hydrate compound serves as a ballistic modifier, which can serve to increase burn rate, reduce pressure sensitivity, reduce temperature sensitivity, and the like. The thermally stable crystalline hydrate compound may be selected from the group consisting of: a copper phthalate hydrate, copper pyromellitate dihydrate, copper fumarate dihydrate, copper (3-nitrophthalate) dihydrate, and combinations thereof.

19 Claims, No Drawings

GAS GENERANT COMPOSITIONS COMPRISING A THERMALLY STABLE CRYSTALLINE HYDRATE COMPOUND FOR COOLING COMBUSTION FLAME TEMPERATURE AND IMPROVING BALLISTIC PERFORMANCE

FIELD

The present disclosure relates to a gas generant composition for an automotive inflatable restraint system having a fuel comprising a thermally stable crystalline hydrate compound with a water release temperature of greater than or equal to about 140° C.

BACKGROUND

This section provides background information related to the present disclosure which is not necessarily prior art.

Passive inflatable restraint systems have been used for over twenty-five years in various applications, such as automobiles. Certain types of passive inflatable restraint systems minimize occupant injuries by using a pyrotechnic gas generant to inflate an airbag cushion (e.g., gas initiators and/or inflators) or to actuate a seatbelt tensioner (e.g., micro gas generators), for example. Automotive airbag inflator performance and safety requirements are continually increasing to enhance passenger safety, while concurrently striving to increase functionality and reduce manufacturing costs.

Suitable gas generants provide sufficiently high gas output at a high mass flow rate in a desired time interval to achieve a required work impulse for the inflating device. One way of optimizing gas generant performance and reducing system cost is to reduce the combustion flame temperature of the gas generant formulation. This may seem counterintuitive because gas temperature influences the amount of work the generant gases can do. However, high gas temperatures can be undesirable because burns and related thermal damage can result. In addition, high gas temperatures can also lead to an excessive reliance or sensitivity of the gas to heat transfer and excessively rapid deflation profiles, which can be undesirable. In order to mitigate the effects of high combustion flame temperatures (for example, for purposes of the present disclosure, a high flame temperature may be considered anything in excess of 1700K at combustion), a significant portion of the mass of an inflator is often relegated to heat sink in combination with filtration systems. This detrimentally affects the weight of the inflator and thus the efficiency of the system. Hence, for new advanced inflator designs, it is desirable to reduce or minimize filter components and heat sink requirements as much as possible. As part of these new designs, new cool burning gas generant formulations are advantageous because they reduce heat sink requirements and improve performance.

Consequently, it is desirable to achieve a high gas output at a high mass flow rate and at a relatively low flame temperature in a gas generant formulation used for automotive airbag applications. Gas generant flame temperatures less than approximately 1700 K have been shown to enable inflator devices with reduced filtration that operate in a manner that provides adequate restraint and protection without the risk of burns or injury to an automobile occupant in the event of a crash.

Another desirable feature of a gas generant is that it has minimal change in performance over a range of temperatures, for example, from −40° C. to 80° C. corresponding to the maximum temperature extremes an automobile is likely to see in service. Airbag inflators and modules are designed to function reliably and safely at the temperature extremes taking into account the increased performance of the gas generant at the upper temperature limit. If the change in performance of the gas generant can be minimized over the temperature extremes, less demand is placed on the inflator hardware design resulting in a lower cost, lighter weight product.

SUMMARY

This section provides a general summary of the disclosure, and is not a comprehensive disclosure of its full scope or all of its features.

Advantageously, the present disclosure in certain variations provides a gas generant composition for an automotive inflatable restraint system. The gas generant composition comprises a fuel having a thermally stable crystalline hydrate compound with a water release temperature of greater than or equal to about 140° C. measured by differential scanning calorimetry (DSC) with a heating rate of 5° C./minute with a tolerance of ±0.1° C./minute.

In one aspect, the fuel having a thermally stable crystalline hydrate compound is selected from the group consisting of: a copper phthalate hydrate, copper pyromellitate dihydrate, copper fumarate dihydrate, copper (3-nitrophthalate) dihydrate, and combinations thereof.

In one aspect, the gas generant composition has a sensitivity to temperature coefficient ($\sigma_P$) of less than or equal to about 0.2%/° C.

In one aspect, the gas generant composition has a burning rate variability $\pi_k$ of less than or equal to about 0.25%/° C.

In one aspect, the gas generant composition has a linear burn rate of greater than or equal to about 18 mm per second at a pressure of about 21 megapascals (MPa), a linear burn rate pressure exponent of less than or equal to about 0.35, a gas yield of greater than or equal to about 5.7 moles/100 $cm^3$, and a maximum flame temperature at combustion ($T_c$) of less than or equal to about 1700K (1,427° C.).

In one aspect, the thermally stable crystalline hydrate compound is present at greater than 0% to less than or equal to about 12% by weight of the total gas generant composition.

In one further aspect, the fuel having the thermally stable crystalline hydrate compound is a first fuel and the gas generant composition further comprises one or more additional fuels present at greater than or equal to about 10% to less than or equal to about 20% by weight of the total gas generant composition; one or more oxidizers are present at greater than or equal to about 30% to less than or equal to about 70% by weight of the total gas generant composition; and one or more gas generant additives are present at greater than or equal to 0% to less than or equal to about 10% by weight of the total gas generant composition.

In one further aspect, the one or more additional fuels are selected from the group consisting of: guanidine nitrate, diammonium 5,5'-bitetrazole (DABT), copper bis guanylurea dinitrate, hexamine cobalt (III) nitrate, copper diammine bitetrazole, a melamine oxalate compound, and combinations thereof. The one or more oxidizers are selected from the group consisting of: basic copper nitrate, alkali metal or alkaline earth metal nitrates, alkali metal, alkaline earth metal, or ammonium perchlorates, metal oxides, and combinations thereof. Further, the one or more gas generant additives are selected from the group consisting of: silicon dioxide, aluminum oxide, and combinations thereof.

In one aspect, the fuel having the thermally stable crystalline hydrate compound is a first fuel present at greater than 0% to less than or equal to about 12% by weight of the total gas generant composition and the gas generant composition further comprises:

guanidine nitrate as a second fuel present at greater than or equal to about 15% to less than or equal to about 50% by weight of the total gas generant composition;

a third fuel present at greater than or equal to 0% to less than or equal to about 20% by weight of the total gas generant composition;

basic copper nitrate present at greater than or equal to about 30% to less than or equal to about 70% by weight of the total gas generant composition; and one or more slagging agents present at greater than or equal to 0% to less than or equal to about 5% by weight of the total gas generant composition.

In one aspect, the thermally stable crystalline hydrate compound comprises a copper phthalate hydrate and the third fuel comprises a melamine oxalate compound.

Advantageously, the present disclosure in certain further variations provides a gas generant composition for an automotive inflatable restraint system comprising a copper phthalate hydrate compound.

In one aspect, the gas generant composition has a sensitivity to temperature coefficient ($\sigma_P$) of less than or equal to about 0.2%/° C. and a burning rate variability $\pi_k$ of less than or equal to about 0.25%/° C.

In one aspect, the gas generant composition has a linear burn rate of greater than or equal to about 18 mm per second at a pressure of about 21 megapascals (MPa), a linear burn rate pressure exponent of less than or equal to about 0.35, a gas yield of greater than or equal to about 5.7 moles/100 $cm^3$, and a maximum flame temperature at combustion ($T_c$) of less than or equal to about 1700K (1,427° C.).

In one aspect, the copper phthalate compound is present at greater than 0% to less than or equal to about 10% by weight of the total gas generant composition.

In one further aspect, the copper phthalate hydrate is a first fuel and the gas generant composition further comprises one or more additional fuels present at greater than or equal to about 10% to less than or equal to about 20% by weight of the total gas generant composition; one or more oxidizers are present at greater than or equal to about 30% to less than or equal to about 70% by weight of the total gas generant composition; and one or more gas generant additives are present at greater than or equal to 0% to less than or equal to about 10% by weight of the total gas generant composition.

In one further aspect, the one or more additional fuels are selected from the group consisting of: guanidine nitrate, diammonium 5,5'-bitetrazole (DABT), copper bis guanylurea dinitrate, hexamine cobalt (III) nitrate, copper diammine bitetrazole, a melamine oxalate compound, and combinations thereof. The one or more oxidizers are selected from the group consisting of: basic copper nitrate, alkali metal or alkaline earth metal nitrates, alkali metal, alkaline earth metal, or ammonium perchlorates, metal oxides, and combinations thereof. Further, the one or more gas generant additives are selected from the group consisting of: silicon dioxide, aluminum oxide, and combinations thereof.

In one aspect, the copper phthalate hydrate is a first fuel present at greater than 0% to less than or equal to about 10% by weight of the total gas generant composition and the gas generant composition further comprises:

guanidine nitrate is a second fuel present at greater than or equal to about 15% to less than or equal to about 50% by weight of the total gas generant composition;

a third fuel is present at greater than or equal to 0% to less than or equal to about 20% by weight of the total gas generant composition;

basic copper nitrate present at greater than or equal to about 30% to less than or equal to about 70% by weight of the total gas generant composition; and one or more slagging agents present at greater than or equal to 0% to less than or equal to about 5% by weight of the total gas generant composition.

In one aspect, the third fuel comprises a melamine oxalate compound.

Advantageously, the present disclosure in certain other variations provides a cool burning gas generant composition for an automotive inflatable restraint system comprising a copper phthalate hydrate compound. The cool burning gas generant composition has a maximum flame temperature at combustion ($T_c$) of less than or equal to about 1700K (1,427° C.), a sensitivity to temperature coefficient ($\sigma_P$) of less than or equal to about 0.2%/° C. and a burning rate variability $\pi_k$ of less than or equal to about 0.25%/° C.

In one aspect, the copper phthalate hydrate is a first fuel present at greater than 0% to less than or equal to about 10% by weight of the total gas generant composition and the gas generant further comprises:

guanidine nitrate is a second fuel present at greater than or equal to about 15% to less than or equal to about 50% by weight of the total gas generant composition;

a melamine oxalate compound is a third fuel present at greater than or equal to 0% to less than or equal to about 20% by weight of the total gas generant composition;

basic copper nitrate present at greater than or equal to about 30% to less than or equal to about 70% by weight of the total gas generant composition; and one or more slagging agents present at greater than or equal to 0% to less than or equal to about 5% by weight of the total gas generant composition.

Further areas of applicability will become apparent from the description provided herein. The description and specific examples in this summary are intended for purposes of illustration only and are not intended to limit the scope of the present disclosure.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

As used herein, the terms "composition" and "material" are used interchangeably to refer broadly to a substance containing at least the preferred chemical constituents, elements, or compounds, but which may also comprise additional elements, compounds, or substances, including trace amounts of impurities, unless otherwise indicated.

The present disclosure contemplates a composition for gas generant that can be in the form of a solid grain, a pellet, a tablet, or the like. As the gas generant burns it creates a gas or effluent for inflation that is directed to an inflating device (e.g., airbag) within the inflatable restraint system. Various different gas generant compositions are used in vehicular occupant inflatable restraint systems. Gas generant material selection involves various factors, including meeting current industry performance specifications, guidelines and standards, generating safe gases or effluents, handling safety of the gas generant materials, durational stability of the materials, and cost-effectiveness in manufacture, among other considerations. It is preferred that the gas generant compositions are safe during handling, storage, and disposal, and preferably are azide-free.

In various aspects, the gas generant typically includes at least one fuel component and at least one oxidizer component, and may include other minor ingredients, that once ignited combust rapidly to form gaseous reaction products (e.g., $CO_2$, $H_2O$, and $N_2$). One or more fuel compounds undergo rapid combustion to form heat and gaseous products; e.g., the gas generant burns to create heated inflation gas for an inflatable restraint device or to actuate a piston. The gas-generating composition also includes one or more oxidizing components, where the oxidizing component reacts with the fuel component in order to generate the gas product. "Slag" or "clinker" is another name for solid combustion products formed during combustion of the gas generant material. Ideally, the slag will maintain the original shape of the gas generant (e.g., grain, pellet, or tablet) and be large and easily filtered. This is particularly important when the inflator design includes a reduced mass filtration system for the purpose of reducing the inflator size and weight such as can be used with cool burning gas generant formulations.

Advanced inflator design concepts incorporate reduced filter and heat sink mass, as well as reduced containment wall thickness to achieve significant weight reduction in the inflator. Use of cool burning gas generant formulations reduces heat sink requirements. Additionally, because filter mass is reduced, it is desirable to have a cool burning gas generant that slags very well. By "slagging," it is meant that certain solid combustion products generated during burning of the gas generant form a large integral solid mass that is retained inside the combustion chamber during combustion, rather than passing through the filter into the airbag. Slagging agents can be used to achieve this effect. A slagging agent is a compound or material, usually inert to combustion, which melts at combustion temperatures and agglomerates or collects all of the solid combustion products together. Examples of conventional slagging agents are silicon dioxide, aluminum oxide, glass and other metal oxides that melt at or near the combustion flame temperature.

As noted above, one way of optimizing gas generant performance and reducing system cost of gas generants for passive restraint systems is to reduce the combustion flame temperature of the gas generant formulation. In an efficient inflator design, the amount of screen pack used would be sufficient to filter the gas stream and to cool the gas stream from combustion for a desired quantity of gas generant to a desired temperature before entering an airbag. The desired combustion flame temperature for a gas generant formulation used in a frontal automotive inflator application is in a range of greater than or equal to about 1400K (1,127° C.) to less than or equal to 1900K (1,627° C.). In addition to combustion flame temperature, as noted above, two other important gas generant characteristics that help to improve the efficiency of the inflator and thus its size and weight are the gas yield of the gas generant and the ability of the solid combustion products to form a slag and thus stay in a large consolidated mass that is easily filtered from the gas stream.

A common expression of burning rate law is as follows:

$$r_b = ae^{bT}P^n \quad \text{(Eqn. 1)}$$

where $r_b$ is a burning rate as a function of temperature and pressure; $\alpha$ is a pressure coefficient, P is pressure, n is a pressure exponent, T is a temperature of the environment, and b is a sensitivity to temperature coefficient.

All of the parameters in the burning rate law can be graphically determined or calculated by performing burning rate experiments across a range of pressures and temperatures. $\alpha$ is the Y intercept of a plot of log $R_b$ versus log p at constant T. n is a slope of a plot of log-log of linear burn rate $R_b$ versus log P at constant T. b or as it is also commonly known, $\sigma_P$, can be calculated using the following equation:

$$\sigma_P = \frac{1}{R_b}\left[\frac{\delta R_b}{\delta T_i}\right] = \left[\frac{\delta \ln R_b}{\delta T_i}\right]. \quad \text{(Eqn. 2)}$$

Another commonly used measure of performance or burning rate variability is called $\pi_k$ which is the variation in burning rate with temperature at a constant Klemmung or area ratio of the exit orifice of the device to the burning surface of the gas generant. $\pi_k$ is related to $\sigma_P$ by the following equation:

$$\pi_k = \frac{\sigma_P}{1-n}. \quad \text{(Eqn. 3)}$$

From the above Equation 3, it can be deduced that minimization of $\pi_k$ can be accomplished by minimization of the burning rate sensitivity to temperature ($\sigma_P$) and burning rate sensitivity to pressure (n). Both $\sigma_P$ and n are function of the ingredients selected for use in the gas generant formulation. In typical gas generant formulation, n varies from 0.35 to 0.50, $\sigma_P$ varies from 0.10 to 0.20%/° C. Therefore, in accordance with various aspects of the present disclosure, a gas generant formulation is provided that has an n value less than 0.35, relatively low $\sigma_P$ and $\pi_k$ values, and a cool burning flame temperature of less than or equal to about 1700K (1,427° C.), optionally less than or equal to about 1600K (1,327° C.).

In various aspects, the present disclosure provides a gas generant that comprises an ingredient, a fuel compound having a thermally stable crystalline hydrate compound with a water release temperature of greater than or equal to about 140° C., which is a ballistic modifier that reduces flame temperatures at combustion while also reducing sensitivity of the gas generant formulation's burn rate sensitivity to temperature and pressure. In certain aspects, the fuel compound having a thermally stable crystalline hydrate compound is selected from the group consisting of: a copper phthalate hydrate, copper pyromellitate dihydrate, copper fumarate dihydrate, copper (3-nitrophthalate) dihydrate, and combinations thereof. In certain variations, the present disclosure provides a gas generant that comprises a thermally stable crystalline hydrate compound, which is such a ballistic modifier. In certain aspects, the thermally stable crystalline hydrate compound included in gas generant compositions result in cool burning gas generant compositions that allow low flame temperatures at combustion (e.g., ≥about 1400K (1,127° C.) to ≤about 1600K (1,327° C.)) to be obtained while maintaining good performance, especially those that can employ certain oxidizer and fuel combinations, like basic copper nitrate and guanidine nitrate. As discussed further below, thermally stable crystalline hydrate compound, like the copper phthalate hydrate compound, participates in combustion (e.g., as a fuel). Further, the thermally stable crystalline hydrate compound, such as copper phthalate hydrate, has a high cooling capacity due to the presence of water of hydration, while maintaining a good gas yield.

In certain variations, a gas generant composition for an automotive inflatable restraint system is provided that comprises a fuel having a thermally stable crystalline hydrate compound that has a water release temperature of greater than or equal to about 140° C., when heated at a uniform heating rate of 5° C./minute with a tolerance of +/−0.1° C./min in a differential scanning calorimeter (DSC). For purposes of this test, a 2 mg±0.1 mg powder sample could be used. A DSC device from TA Instruments is suitable for this test. The water release temperature is the temperature at which water incorporated into a salt will start to dissociate from the salt when heated at a uniform heating rate in a DSC. This can be tested when a stoichiometric amount of water is incorporated into a salt with sufficient attractive forces. In certain aspects, the thermally stable hydrate compound has a water release temperature optionally greater than or equal to about 150° C., optionally greater than or equal to about 160° C., optionally greater than or equal to about 165° C., and in certain variations, optionally greater than or equal to about 170° C. In most hydrated salts, the chemical bonds that attach the water molecules to the salt are quite weak. Thus, water of hydration is typically lost in compounds around 100° C., so that the water of hydration may be removed from the compound during accelerated aging tests or in extreme duty environments, rather than during the desired combustion. The stable water of hydration in compounds like copper phthalate hydrate is crystalline and unexpectedly was discovered to be present during the overall gas generant reaction and thus to advantageously serve as a coolant during combustion.

The representative structure of copper phthalate hydrate is shown below:

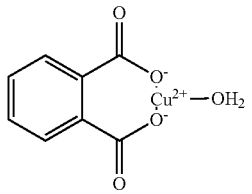

Copper phthalate hydrate has a thermally stable water of hydration (volatizes at about 170° C.), which makes it a cool burning co-fuel for inclusion in a gas generant formulation. As noted above, the crystalline nature of the water of hydration and its stability in compounds like copper phthalate hydrate was unexpectedly discovered to be present during the overall gas generant reaction and thus such a compound advantageously serves as both a coolant and a fuel during combustion.

In other aspects, the present disclosure contemplates a gas generant composition that comprises a fuel compound having a thermally stable crystalline hydrate compound in the form of a copper pyromellitate dihydrate ($C_{10}H_6O_8Cu_2.2H_2O$) represented by the structure below:

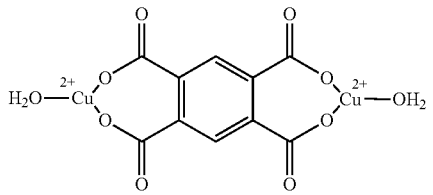

Copper pyromellitate dihydrate has a thermally stable water of hydration that has a water release temperature of about 200° C.

In another variation, the present disclosure contemplates a gas generant composition that comprises a fuel compound having a thermally stable crystalline hydrate compound in the form of a copper fumarate dihydrate represented by the structure below:

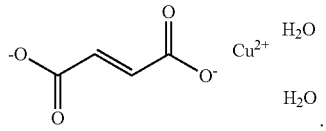

Copper fumarate dihydrate has a thermally stable water of hydration that is removed from the compound at a water release temperature of about 140° C. to about 150° C.

In yet other aspects, the present disclosure contemplates a gas generant composition that comprises a fuel compound having a thermally stable crystalline hydrate compound in the form of a copper (3-nitrophthalate) dihydrate represented by the structure:

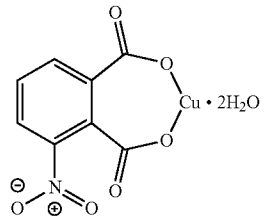

Copper-3-Nitrophthalate Dihydrate

Copper (3-nitrophthalate) dihydrate has a thermally stable water of hydration that is removed from the compound at a water release temperature of about 140° C. to about 150° C.

Thus, in various aspects, the present disclosure contemplates a gas generant composition including a thermally stable crystalline hydrate compound that has a water release temperature of greater than or equal to about 140° C. measured by differential scanning calorimetry (DSC) with a heating rate of 5° C./minute with a tolerance of ±0.1° C./minute and serves as a ballistic modifier of the gas generant. As discussed further herein, inclusion of the thermally stable crystalline hydrate compound, such as copper phthalate hydrate compound, in a gas generant composition provides not only a cool burning formulation, but also one that meets certain desirable ballistic properties, including by way of non-limiting example, low variation in burning rate over a range of operating temperatures (e.g., minimal sensitivity to temperature) and pressures (e.g., minimal sensitivity to pressure), high gas yield, and suitable linear burn rates.

While not limited to cool burning gas generant compositions, in certain aspects, the gas generant composition includes a thermally stable crystalline hydrate compound that can be used as a co-fuel in a relatively cool burning gas generant composition. The gas generant composition may also comprise another primary fuel, one or more additional co-fuels, along with at least one oxidizer. In certain aspects, a cool burning gas generant may be considered to have a combustion flame temperature of less than or equal to approximately 1900K (1,627° C.), optionally less than or equal to about 1700K (1,427° C.), and in certain variations, optionally less than or equal to approximately 1600K (1,327° C.). Such cool burning gas generants have been shown to enable inflator devices with reduced filtration, which operate in a manner that provides adequate restraint and protection, without the risk of burns or injury to an automobile occupant in the event of a crash. Thus, minimizing flame temperature is advantageous. However, as noted above, the thermally stable crystalline hydrate compound may be used in a ballistic modifier of any gas generant and is not necessarily limited to cool burning gas generants. A thermally stable crystalline hydrate compound, like copper phthalate hydrate, is also useful in improving ballistics of hotter burning formulations (e.g., near or above about 1900 K (1,627° C.) without increasing the flame temperature.

In certain variations, the gas generant composition comprising the thermally stable crystalline hydrate compound is a cool burning formulation having a maximum flame temperature at combustion ($T_c$) of less than or equal to about 1900K (1,627° C.), optionally less than or equal to about 1700K (1,427° C.), and in certain other aspects, optionally within a maximum flame temperature ranging from greater than or equal to about 1400K (1,127° C.) to less than or equal to 1600K (1,327° C.). A thermally stable crystalline hydrate compound, like copper phthalate hydrate, is combusted during the decomposition reaction of the gas generant and thus, the compound decomposes within this temperature range. During the reaction, the thermally stable crystalline hydrate compound may release water, either as a combustion product and/or from the water of hydration, and carbon dioxide.

Thus, in accordance with various aspects of the present teachings, an improved cool burning gas generant composition is provided that includes a thermally stable crystalline hydrate compound with a water release temperature of greater than or equal to about 140° C. (measured by differential scanning calorimetry (DSC) with a heating rate of 5° C./minute with a tolerance of ±0.1° C./minute) that has a volumetric gas yield of optionally greater than or equal to about 5.7 moles/100 $cm^3$ of gas generant. The product of gravimetric gas yield and density is a volumetric gas yield. In certain embodiments, the volumetric gas yield is greater than or equal to about 5.8 moles/100 $cm^3$ of gas generant, optionally greater than or equal to about 5.9 moles/100 $cm^3$ of gas generant, optionally greater than or equal to about 6.0 moles/100 $cm^3$ of gas generant, optionally greater than or equal to about 6.1 moles/100 $cm^3$ of gas generant, and in certain variations, optionally greater than or equal to about 6.2 moles/100 $cm^3$ of gas generant.

In certain variations, the gas generant has a mass density of greater than about 2 g/$cm^3$, optionally greater than or equal to about 2.1 g/$cm^3$, and in certain variations, optionally greater than or equal to about 2.2 g/$cm^3$.

In various embodiments, the gas generant provided by the present disclosure has a desirably high burning rate that enables desirable pressure curves for inflation of an airbag. A linear burn rate "$r_b$" for a gas generant material may be expressed in length per time at a given pressure. In accordance with various aspects of the present disclosure, the gas generant has a linear burn rate of greater than or equal to about 18 mm per second at a pressure of about 21 megapascals (MPa). In certain embodiments, the burn rate for the gas generant is greater than or equal to about 19 mm per second at a pressure of about 21 MPa, optionally greater than or equal to about 20 mm per second at a pressure of about 21 MPa, optionally greater than or equal to about 21 mm per second at a pressure of about 21 MPa, optionally greater than or equal to about 22 mm per second at a pressure of about 21 MPa, and optionally greater than or equal to about 23 mm per second at a pressure of about 21 MPa.

Another important aspect of a gas generant material's performance is low burning rate variation, as reflected by its burn rate pressure sensitivity and/or burn rate temperature sensitivity, which as discussed above, is related to the pressure exponent or the slope (n) of the linear regression line of the logarithmic-logarithmic plot of burn rate ($r_b$) versus pressure (P). It is generally desirable to develop gas generant materials that exhibit reduced or lessened burn rate sensitivity, for example, sensitivity to changes in temperature can potentially lead to undesirable performance variability, such as when the corresponding material or formulation is reacted under different temperature conditions. "Temperature sensitivity" generally refers to undesirable temperature variation in a burn rate of a gas generant over a range of potential operating temperatures for a gas inflator, for example, from about −40° C. to about 80° C., which can result in undesirable combustion variability. Minimizing temperature sensitivity of a gas generant through a range of cold temperatures of −40° C. to hot temperatures of 80° C., for example, is advantageous so that the burn rate only has a minor deviation through the temperature range, for example, less than about 10-15%. This temperature range results in a pressure swing of ±10-15%. In various aspects, a gas generant composition is provided that has improved ballistic performance, in particular, a reduced burn rate pressure sensitivity, a reduced burn rate temperature sensitivity, and an increased linear burning rate of the gas generant material as it is used in an inflator device. In various aspects, the gas generants of the present disclosure have improved pressure sensitivity (i.e., reduced pressure sensitivity), improved temperature sensitivity (i.e., reduced temperature sensitivity) and enhanced combustion performance, for example, by having reduced linear burn rate pressure sensitivity (i.e., a relatively low pressure exponent (n) or slope of a linear regression line drawn through a log-log plot of burn rate ($r_b$) versus pressure (P)), reduced linear burn rate temperature sensitivity (e.g., a sensitivity to temperature coefficient ($\sigma_P$) of less than or equal to about 0.2%/° C. and $\pi_k$, performance or burning rate variability, of less than or equal to about 0.25%/° C.), higher linear burn rate (i.e., rate of combustion reaction), or combinations thereof.

In certain aspects, a gas generant material having an acceptable pressure sensitivity has a linear burning rate slope of less than or equal to about 0.35, optionally less than or equal to about 0.3. A material having a burn rate slope of less than or equal to about 0.35 fulfills hot to cold performance variation requirements, and can reduce performance variability and pressure requirements of the inflator as well. Thus, in various aspects, it is desirable that the gas generant materials have a constant slope over the pressure range of inflator operation, which is typically about 1,000 psi (about 6.9 MPa) to about 5,000 psi (about 34.5 MPa) and desirably has a constant slope that is less than or equal to about 0.35.

In certain other aspects, the gas generants provided by the present disclosure provide a sensitivity to temperature coefficient ($\sigma_P$) of less than or equal to about 0.2%/° C. In some variations, the sensitivity to temperature coefficient ($\sigma_P$) of the gas generants may be greater than or equal to about 0.1%/° C. to less than or equal to about 0.2%/° C.

In yet other aspects, the gas generants provided by the present disclosure provide a $\pi_k$, or performance or burning rate variability, which is the variation in burning rate with temperature at a constant Klemmung or area ratio of the exit orifice of the device to burning surface of the gas generant. As discussed previously above, $\pi_k$ is a derived value from $\sigma_P$ and can be minimized by minimizing the burning rate sensitivity to temperature ($\sigma_P$) and burning rate sensitivity to pressure (n). Thus, $\pi_k$ may be less than or equal to about 0.25%/° C.

The cool burning gas generant composition according to various aspects of the present teachings includes a thermally stable crystalline hydrate compound with a water release temperature of greater than or equal to about 140° C. as a co-fuel. As will be discussed further below, an amount of the thermally stable crystalline hydrate compound is selected to provide desired levels of gas yield or output, having a relatively low pressure exponent (n), and desirably high burn rate. In certain variations, the thermally stable crystalline hydrate compound is present at greater than 0% by weight to less than or equal to about 15% by weight of the total gas generant composition, optionally greater than 0% by weight to less than or equal to about 12% by weight of the total gas generant composition, and in certain variations, optionally greater than 0% by weight to less than or equal to about 10% by weight of the total gas generant composition. In certain other aspects, the thermally stable crystalline hydrate compound is present at greater than or equal to about 1% by weight to less than or equal to about 6% by weight of the total gas generant composition or optionally greater than or equal to about 2% by weight to less than or equal to about 5% by weight of the total gas generant composition.

Where the thermally stable crystalline hydrate compound comprises copper fumarate dihydrate, the thermally stable crystalline hydrate compound may be present at less than or equal to about 15% by weight of the total gas generant composition, optionally less than or equal to about 12% by weight of the total gas generant composition, and in certain aspects, at less than or equal to about 10% by weight of the total gas generant composition. At such levels of copper fumarate dihydrate, the gas generant composition provides the desired ballistic performance. In certain other variations, where the thermally stable crystalline hydrate compound comprises copper phthalate hydrate and/or copper pyromellitate dihydrate, the thermally stable crystalline hydrate compound may be present at less than or equal to about 10% by weight. In certain variations, the thermally stable crystalline hydrate compound is present at greater than 0% by weight to less than or equal to about 10% by weight of the total gas generant composition, optionally greater than or equal to about 1% to less than or equal to about 6% by weight of the total gas generant composition, optionally greater than or equal to about 2% to less than or equal to about 5% by weight of the total gas generant composition. At these levels of copper phthalate hydrate and/or copper pyromellitate dihydrate, the gas generant composition provides the desired ballistic performance.

The cool burning gas generants may also comprise one or more other fuels in addition to the thermally stable crystalline hydrate compound. Materials are generally categorized as gas generant fuels due to their relatively low burn rates, and are often combined with one or more oxidizers in order to obtain desired burn rates and gas production. As appreciated by those of skill in the art, such a fuel component may be combined with additional components in the gas generant, such as co-fuels when multiple fuels are employed or oxidizers. Most fuels known in the art can be used with the present technology and are generally selected to impart certain desirable characteristics to the gas generant formulation, such as gas yield, burning rate, thermal stability, and low cost. These fuels can be organic compounds containing two or more of the elements: carbon (C), hydrogen (H), nitrogen (N), and oxygen (O). The fuels can also include transition metal salts and transition metal nitrate complexes. In certain variations, preferred transition metals are copper and/or cobalt. In accordance with certain aspects of the present teachings, a fuel is selected for the inventive gas generant compositions so that when combusted with certain oxidizers comprising copper, such as basic copper nitrate, a resulting maximum combustion flame temperature ($T_c$) is less than or equal to about 1700K (1,427° C.) and may fall within a range of greater than or equal to about 1400K (1,127° C.) to less than or equal to 1600K (1,327° C.) in certain variations.

Examples of fuels useful for gas generants according to the present teachings are selected from the group consisting of guanidine nitrate, diammonium 5,5'-bitetrazole (DABT), copper bis guanylurea dinitrate, hexamine cobalt (III) nitrate, copper diammine bitetrazole, and combinations thereof. Fuels may be used singly or in combination with other co-fuels in addition to the thermally stable crystalline hydrate compound to impart the desired combustion characteristics. In addition to the thermally stable crystalline hydrate compound with a water release temperature of greater than or equal to about 140° C., the cool burning gas generant may comprise such additional fuel(s) respectively present at greater than or equal to about 10% by weight to less than or equal to about 50% by weight and optionally at greater than or equal to about 10% by weight to less than or equal to about 20% by weight of the total gas generant composition. A suitable cool burning gas generant composition optionally includes a total amount of fuels, including the thermally stable crystalline hydrate compound, of greater than or equal to about 15% to less than or equal to about 80% by weight, optionally greater than or equal to about 25% to less than or equal to about 70%, optionally greater than or equal to about 30% to less than or equal to about 55% of all fuel components in the total gas generant composition.

As appreciated by those of skill in the art, such fuel components may be combined with additional components in the gas generant, such as co-fuels or oxidizers. For example, in certain embodiments, a gas generant composition comprises a basic metal nitrate oxidizer, as described above, and a nitrogen-containing co-fuel like guanidine nitrate. The desirability of use of various co-fuels, such as guanidine nitrate or diammonium 5,5'-bitetrazole (DABT), in the gas generant compositions of the present disclosure is generally based on a combination of factors, such as burn rate, cost, stability (e.g., thermal stability), availability and compatibility (e.g., compatibility with other standard or useful pyrotechnic composition components).

In certain variation, the gas generants of the present disclosure further comprise melamine oxalate compounds as a co-fuel. The melamine oxalate compound participates in combustion (e.g., as a fuel) and can eliminate the need to use a large particle size endothermic coolant, such as large particle size aluminum hydroxide. Further, the melamine oxalate compound has a high cooling capacity, which allows relatively small amounts of the compound to cool the formulation to desired temperatures, thereby maintaining a high gas yield. Melamine, which is slightly basic, and oxalic acid react to form a salt compound. The compound formed depends on the ratio of melamine to oxalic acid present. A 1:1 molar ratio of melamine to oxalic acid forms melamine monoxalate, represented by the structure:

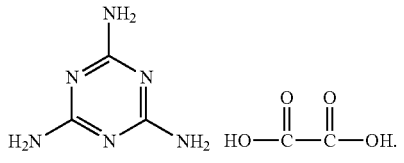

The CAS number for melamine monoxalate is 67797-68-6.

A 2:3 (alternatively 1:1.5) molar ratio of melamine to oxalic acid forms dimelamine trioxalate represented by the structure:

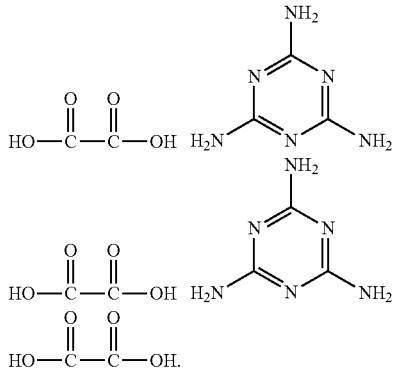

The CAS number for trimelamine trioxalate is 8214-01-4. In certain aspects, the melamine oxalate compound may have combinations of these respective salts so that the ratio of melamine to oxalic acid may range from about 1:1 to about 2:3.

Thus, in various aspects, the present disclosure contemplates a gas generant composition including a melamine oxalate compound selected from the group consisting of: melamine monoxalate, dimelamine trioxalate, and combinations thereof. Inclusion of the melamine oxalate compound in a gas generant composition provides not only a cool burning formulation, but also one that meets certain desirable ballistic properties, including by way of non-limiting example, high gas yield, suitable linear burn rates, and minimal burn rate sensitivity to pressure.

A gas generant composition optionally includes a melamine oxalate compound as a fuel at greater than or equal to 0% to less than or equal to about 20% by weight, optionally greater than 0% to less than or equal to about 10% by weight of the total gas generant composition.

Certain suitable oxidizers for the gas generant compositions of the present disclosure include, by way of non-limiting example, alkali metal (e.g., elements of Group 1 of IUPAC Periodic Table, including Li, Na, K, Rb, and/or Cs), alkaline earth metal (e.g., elements of Group 2 of IUPAC Periodic Table, including Be, Ng, Ca, Sr, and/or Ba), and ammonium nitrates, nitrites, and perchlorates; metal oxides (including Cu, Mo, Fe, Bi, La, and the like); basic metal nitrates (e.g., elements of transition metals of Row 4 of IUPAC Periodic Table, including Mn, Fe, Co, Cu, and/or Zn); transition metal complexes of ammonium nitrate (e.g., elements selected from Groups 3-12 of the IUPAC Periodic Table); metal ammine nitrates, metal hydroxides, and combinations thereof. One or more co-fuels/oxidizers are selected along with the fuel component to form a gas generant that upon combustion achieves an effectively high burn rate and gas yield from the fuel. One non-limiting, specific example of a suitable oxidizer includes basic copper nitrate. The gas generant may include combinations of oxidizers, such that the oxidizers may be nominally considered a primary oxidizer, a second oxidizer, and the like.

Oxidizing agents may be respectively present in a gas generant composition in an amount of less than or equal to about 70% by weight of the gas generating composition; optionally less than or equal to about 60% by weight; optionally less than or equal to about 50% by weight; optionally less than or equal to about 40% by weight; optionally less than or equal to about 30% by weight; optionally less than or equal to about 25% by weight; optionally less than or equal to about 20% by weight; and in certain aspects, less than or equal to about 15% by weight of the gas generant composition.

In certain variations of the present disclosure, the gas generant composition comprises a total amount of oxidizers of greater than or equal to about 30% to less than or equal to about 70% by weight and in certain variations, optionally greater than or equal to about 35% to less than or equal to about 60% by weight of the total gas generant composition. Where a secondary oxidizer, such as a perchlorate, is included in combination with a primary oxidizer, such as basic copper nitrate, it may be limited to an amount of greater than or equal to about 1% by weight to less than or equal to about 10% by weight of the total gas generant composition to retain the cool burning properties of the gas generant.

In certain embodiments, a gas generant comprises a fuel in the form of a thermally stable crystalline hydrate compound described above, one or more additional fuels (e.g., a co-fuel), and an oxidizer. In certain variations, a cool burning gas generant comprises a first fuel in the form of a copper phthalate hydrate compound, a second fuel, and an oxidizer. The gas generant composition may be cool burning gas generant with a maximum flame temperature at combustion ($T_c$) of less than or equal to about 1700K (1,427° C.). The gas generant has a linear burn rate of greater than or equal to about 18 mm per second at a pressure of about 21 megapascals (MPa). Further, the gas generant has a gas yield of the gas generant composition of greater than or equal to about 5.7 moles/100 $cm^3$. The gas generant also has a linear burn rate pressure exponent of less than or equal to about 0.35. Further, due to the presence of the thermally stable crystalline hydrate compound, the gas generant may have a sensitivity to temperature coefficient ($\sigma_P$) of less than or equal to about 0.2%/° C. and in certain aspects, optionally greater than or equal to about 0.1%/° C. to less than or equal to about 0.2%/° C. The performance or burning rate variability, $\pi_k$, of the gas generant may be less than or equal to about 0.25%/° C.

In certain embodiments, a gas generant comprises a fuel in the form of a thermally stable crystalline hydrate compound described above, guanidine nitrate, and basic copper nitrate. In certain aspects, the thermally stable crystalline hydrate compound is copper phthalate; so that the gas generant composition comprises a copper phthalate hydrate compound, guanidine nitrate; and basic copper nitrate. The gas generant composition may be a cool burning gas generant having a maximum flame temperature at combustion ($T_c$) of less than or equal to about 1700K (1,427° C.), a linear burn rate of greater than or equal to about 18 mm per second at a pressure of about 21 megapascals (MPa), a gas yield of the gas generant of greater than or equal to about 5.7 moles/100 $cm^3$, and a linear burn rate pressure exponent of less than or equal to about 0.35. The gas generant may have a sensitivity to temperature coefficient ($\sigma_P$) of less than or equal to about 0.2%/° C. and in certain aspects, optionally greater than or equal to about 0.1%/° C. to less than or equal to about 0.2%/° C. The $\pi_k$ the performance or burning rate variability, of the gas generant may be less than or equal to about 0.25%/° C.

In yet other aspects, a gas generant composition comprises a thermally stable crystalline hydrate compound as described above that is a first fuel, one or more additional fuel components, and one or more oxidizers, such as a primary oxidizer and a secondary oxidizer comprising a perchlorate-containing oxidizer. In certain other aspects, a gas generant composition comprises a copper phthalate hydrate compound as a first fuel, at least one additional second fuel component, and one or more oxidizers, such as a primary oxidizer and a secondary oxidizer comprising a perchlorate-containing oxidizer. By way of example, additional fuels may include guanidine nitrate and optionally a melamine oxalate compound, and an oxidizer selected from the group consisting of: basic copper nitrate, alkali metal or alkaline earth metal nitrates, alkali metal, alkaline earth metal, or ammonium perchlorates, metal oxides, and combinations thereof. A particularly suitable oxidizer for the gas generant compositions of the present disclosure is basic copper nitrate. In one variation, an oxidizer may comprise basic copper nitrate as a primary oxidizer and an alkali metal or alkaline earth metal nitrate, or alkali metal, alkaline earth metal, and ammonium perchlorate as a secondary oxidizer.

A gas generant composition may optionally include additional components known to those of skill in the art. Such additives typically function to improve the handling or other material characteristics of the slag, which remains after combustion of the gas generant material; and improve ability to handle or process pyrotechnic raw materials. By way of non-limiting example, additional ingredients for the gas generant composition may be selected from the group consisting of: flow aids, pressing aids, metal oxides, and combinations thereof. If minor ingredients or additives are included in the gas generant, they may be cumulatively present at less than or equal to about 10% by weight of the total gas generant composition, optionally less than or equal to about 5% by weight of the total gas generant composition. By way of example, such an additive may be selected from the group consisting of: flow aids, press aids, slagging agents, coolants, metal oxides, and any combinations thereof. Where present in a gas generant composition, in certain variations each respective additive may be present at greater than or equal to 0% to less than or equal to about 5% by weight; optionally greater than or equal to about 0.1% to less than or equal to about 4% by weight, and in certain variations, optionally greater than or equal to about 0.5% to less than or equal to about 3% by weight of the gas generant, so that the total amount of additives is less than or equal to about 4%.

Press aids used during compression processing, include lubricants and/or release agents, such as graphite, calcium stearate, magnesium stearate, molybdenum disulfide, tungsten disulfide, graphitic boron nitride, may be optionally included in the gas generant compositions, by way of non-limiting example. Conventional flow aids may also be employed, such as high surface area fumed silica.

Slag forming agents or slagging agents may be a refractory compound, e.g., silicon dioxide and/or aluminum oxide. Examples of conventional slagging agents are aluminum, silicon, and titanium dioxides, refractory materials or other metal oxides that melt at or near the combustion flame temperature. Coolants for lowering gas temperature include basic copper carbonate or other suitable carbonates.

The gas generant compositions may optionally include a metal oxide that serves as a viscosity-modifying compound or an additional slag-forming agent (in addition to the endothermic slag-forming component described above). Suitable metal oxides may include silicon dioxide, cerium oxide, ferric oxide, titanium oxide, zirconium oxide, bismuth oxide, molybdenum oxide, lanthanum oxide and the like.

In certain aspects, the gas generant compositions provided in accordance with the present disclosure may be water soluble or capable of being processed by a slurry that can be spray dried to form granules.

A gas generant composition may have an amount of a thermally stable crystalline hydrate compound that provides advantageous ballistic properties, while maintaining a gas yield at an acceptable level (for example, a volumetric gas yield of the gas generant of greater than or equal to about 5.7 moles/100 $cm^3$).

In certain variations, the thermally stable crystalline hydrate compound is present at greater than 0% by weight to less than or equal to about 15% by weight of the total gas generant composition, optionally at greater than 0% by weight to less than or equal to about 12% by weight, and optionally at greater than 0% by weight to less than or equal to about 10% by weight of the total gas generant composition. In addition to the thermally stable crystalline hydrate compound present as a first fuel, the gas generant composition also may have one or more additional co-fuels. For example, the gas generant composition may have a first co-fuel, such as guanidine nitrate, present at greater than or equal to about 10% to less than or equal to about 50% by weight of the total gas generant composition; a second co-fuel, such as melamine oxalate compound, present at greater than or equal to 0% to less than or equal to about 20% by weight of the total gas generant composition, optionally at greater than or equal to about 10% by weight to less than or equal to about 20% by weight; one or more oxidizers, such as basic copper nitrate, are present at greater than or equal to about 30% to less than or equal to about 70% by weight of the total gas generant composition; and greater than or equal to 0% to less than or equal to about 10% by weight of the total gas generant composition of one or more gas generant additives, such as a slagging agent present at greater than or equal to about 0% to less than or equal to about 10% by weight of the total gas generant composition, by way of example.

In certain variations, the present disclosure contemplates a gas generant composition for an automotive inflatable restraint system that comprises a thermally stable crystalline hydrate compound with a water release temperature of greater than or equal to about 140° C., guanidine nitrate, and basic copper nitrate. The gas generant may also comprise melamine oxalate as a co-fuel and one or more additives, such as a slagging agent like silicon dioxide. The gas generant composition may be a cool burning gas generant with a maximum flame temperature at combustion ($T_c$) of less than or equal to about 1700K (1,427° C.), a linear burn rate of greater than or equal to about 18 mm per second at a pressure of about 21 megapascals (MPa), a gas yield of the gas generant of greater than or equal to about 5.7 moles/100 $cm^3$, and a linear burn rate pressure exponent of less than or equal to about 0.35. The gas generant may have a sensitivity to temperature coefficient ($\sigma_P$) of less than or equal to about 0.2%/° C. and in certain aspects, optionally greater than or equal to about 0.1%/° C. to less than or equal to about 0.2%/° C. The $\pi_k$ or the performance or burning rate variability of the gas generant may be less than or equal to about 0.25%/° C.

In certain other variations, the present disclosure contemplates a gas generant composition for an automotive inflatable restraint system that comprises a thermally stable crystalline hydrate compound with a water release temperature of greater than or equal to about 140° C. present at greater than 0% by weight to less than or equal to about 15% by weight of the total gas generant composition, optionally at greater than 0% by weight to less than or equal to about 12% by weight, and optionally at greater than 0% by weight to less than or equal to about 10% by weight of the total gas generant composition. In certain variations, the thermally stable crystalline hydrate compound is selected from the group consisting of copper phthalate hydrate, copper fumarate dihydrate, copper pyromellitate dihydrate, copper (3-nitrophthalate) dihydrate, and combinations thereof. Such a gas generant composition optionally includes one or more additional fuels present at greater than or equal to about 10% to less than or equal to about 50% by weight of the total gas generant composition, optionally at greater than or equal to about 10% by weight to less than or equal to about 20% by weight; one or more oxidizers present at greater than or equal to about 30% to less than or equal to about 70% by weight of the total gas generant composition; and one or more gas generant additives present at greater than or equal to 0% to less than or equal to about 10% by weight of the total gas generant composition. The one or more additional co-fuels are selected from the group consisting of: guanidine nitrate, diammonium 5,5'-bitetrazole (DABT), copper bis guanylurea dinitrate, hexamine cobalt (III) nitrate, copper diammine bitetrazole, a melamine oxalate compound, and combinations thereof. The one or more oxidizers may be selected from the group consisting of: basic copper nitrate, alkali metal or alkaline earth metal nitrates, alkali metal, alkaline earth metal, or ammonium perchlorates, metal oxides, and combinations thereof. The one or more gas generant additives are selected from the group consisting of: silicon dioxide, aluminum oxide, and combinations thereof.

In one embodiment, the thermally stable crystalline hydrate compound is present at greater than 0% to less than or equal to about 10% by weight of the total gas generant composition. In certain variations, the thermally stable crystalline hydrate compound comprises copper phthalate hydrate and the gas generant further comprises guanidine nitrate present at greater than or equal to about 15% to less than or equal to about 50% by weight of the total gas generant composition. Another co-fuel, such as a melamine oxalate compound, may be present at greater than or equal to 0% to less than or equal to about 20% by weight of the total gas generant composition, optionally at greater than or equal to about 10% by weight to less than or equal to about 20% by weight. Basic copper nitrate may be present at greater than or equal to about 30% to less than or equal to about 70% by weight of the total gas generant composition. One or more slagging agents may be present in the gas generant composition at greater than or equal to 0% to less than or equal to about 5% by weight of the total gas generant composition.

In certain variations, the thermally stable crystalline hydrate compound with a water release temperature of greater than or equal to about 140° C. is present at greater than 0% by weight to less than or equal to about 10% by weight of the total gas generant composition, the guanidine nitrate is present at greater than or equal to about 10% to less than or equal to about 50% by weight of the total gas generant composition; the melamine oxalate compound is present at greater than or equal to 0% to less than or equal to about 20% by weight of the total gas generant composition; the basic copper nitrate is present at greater than or equal to about 30% to less than or equal to about 70% by weight of the total gas generant composition; and one or more gas generant additives, such as slagging agents are present at greater than or equal to 0% to less than or equal to about 10% by weight of the total gas generant composition.

In yet other variations, the present disclosure contemplates a gas generant composition for an automotive inflatable restraint system that consists essentially of a thermally stable crystalline hydrate compound with a water release temperature of greater than or equal to about 140° C. selected from the group consisting of copper phthalate hydrate, copper fumarate dihydrate, copper (3-nitrophthalate) dihydrate, copper pyromellitate dihydrate, and combinations thereof, guanidine nitrate, a basic copper nitrate, optionally a melamine oxalate compound co-fuel, and one or more gas generant additives from the group consisting of: flow aids, press aids, slagging agents, coolants, metal oxides, and any combinations thereof. The gas generant composition may be a cool burning gas generant with a maximum flame temperature at combustion ($T_c$) of less than or equal to about 1700K (1,427° C.), a linear burn rate of greater than or equal to about 18 mm per second at a pressure of about 21 megapascals (MPa), a gas yield of the gas generant of greater than or equal to about 5.7 moles/100 $cm^3$, and a linear burn rate pressure exponent of less than or equal to about 0.35. The gas generant may have a sensitivity to temperature coefficient ($\sigma_P$) of less than or equal to about 0.2%/° C. and in certain aspects, optionally greater than or equal to about 0.1%/° C. to less than or equal to about 0.2%/° C. $\pi_k$, the performance or burning rate variability, of the gas generant may be less than or equal to about 0.25%/° C.

In certain other variations, the present disclosure contemplates a gas generant composition for an automotive inflatable restraint system that consists of a thermally stable crystalline hydrate compound with a water release temperature of greater than or equal to about 140° C. selected from the group consisting of copper phthalate hydrate, copper fumarate dihydrate, copper pyromellitate dihydrate, copper (3-nitrophthalate) dihydrate, and combinations thereof, guanidine nitrate, a basic copper nitrate, and optionally a melamine oxalate compound and one or more gas generant additives selected from the group consisting of: flow aids, press aids, slagging agents, coolants, metal oxides, and any combinations thereof. The gas generant composition has a maximum flame temperature at combustion ($T_c$) of less than or equal to about 1700K (1,427° C.), a linear burn rate of greater than or equal to about 18 mm per second at a pressure of about 21 megapascals (MPa), a gas yield of the gas generant of greater than or equal to about 5.7 moles/100 $cm^3$, and a linear burn rate pressure exponent of less than or equal to about 0.35. The gas generant may have a sensitivity to temperature coefficient ($\sigma_P$) of less than or equal to about 0.2%/° C. and in certain aspects, optionally greater than or equal to about 0.1%/° C. to less than or equal to about 0.2%/° C. $\pi_k$, the performance or burning rate variability, of the gas generant may be less than or equal to about 0.25%/° C.

Various embodiments of the inventive technology can be further understood by the specific examples contained herein. Specific non-limiting Examples are provided for illustrative purposes of how to make and use the compositions, devices, and methods according to the present teachings.

Example 1

Gas generants are tested that include a thermally stable crystalline hydrate compound having a water release temperature of greater than or equal to about 140° C. More specifically, gas generant compositions comprising copper phthalate hydrate are tested to assess the effect of copper phthalate hydrate on the burning rate, flame temperature, and gas yield of gas generant formulations containing basic copper nitrate (bCN) and guanidine nitrate ($GuNO_3$) as the main ingredients, along with a small percentage of silicon dioxide ($SiO_2$) as a slagging agent.

TABLE 1

| | Mix 1 | Mix 2 | Mix 3 | Mix 4 | Mix 5 |
|---|---|---|---|---|---|
| % bCN | 46.19 | 49.13 | 51.97 | 57.76 | 63.52 |
| % $GuNO_3$ | 52.81 | 47.37 | 42.03 | 31.24 | 20.48 |
| % $SiO_2$ | 1 | 1 | 1 | 1 | 1 |
| % Cu Phthalate hydrate | 0 | 2.5 | 5 | 10 | 15 |
| Max combustion temperature $T_c$ (K) | 1884 | 1851 | 1819 | 1745 | 1663 |
| Gas production $G_n$ moles/100 g | 2.98 | 2.85 | 2.72 | 2.46 | 2.21 |
| Gas production $G_v$ moles/100 cc | 5.84 | 5.87 | 5.79 | 5.61 | 5.35 |
| Linear burn rate $R_b$ at 21 MPa mm/sec | 12.36 | 14.28 | 16.90 | 17.70 | 18.29 |
| Slope (n) | 0.325 | 0.316 | 0.311 | 0.268 | 0.253 |
| Constant (log a) | 0.036 | 0.045 | 0.055 | 0.082 | 0.095 |
| Gas generant density g/cm$^3$ | 1.96 | 2.06 | 2.13 | 2.28 | 2.42 |

As shown in Table 1, copper phthalate hydrate increases burning rate, reduces pressure sensitivity (n) of the burning rate, increases gas generant density, and reduces flame temperature of the formulation containing basic copper nitrate and guanidine nitrate as the main ingredients. These are all positive effects in terms of having a useful gas generant formulation for automotive airbag applications. However, as can be seen in the $G_n$ and $G_v$ (weight and volumetric measures of gas yield), as the amount of copper phthalate hydrate increases, generally gas output of the formulation is reduced, especially when copper phthalate is present at levels above 10%. This is the negative effect of using copper phthalate hydrate in the formulation. As such, the amount of copper phthalate hydrate to be included is selected so that positive benefits will be realized, while maintaining an adequate gas yield.

To further illustrate this point, Table 2 shows varying an amount (weight percentage) of copper phthalate hydrate from 0-5% in formulations that have basic copper nitrate and guanidine nitrate as the main ingredients and silicon dioxide as a slagging agent. These formulations also contain a high gas yield cool burning co-fuel, a melamine oxalate compound, which enables a desired cool burning flame temperature. A co-oxidizer, ammonium perchlorate, is also present for reducing carbon monoxide in the gaseous products of combustion.

TABLE 2

| | Mix 6 | Mix 7 | Mix 8 |
|---|---|---|---|
| % bCN | 46.93 | 49.01 | 52.54 |
| % $GuNO_3$ | 37.07 | 34.24 | 27.46 |
| % $SiO_2$ | 1 | 1 | 1 |
| % Melamine Monoxalate | 13.50 | 12.25 | 12.5 |
| % Ammonium perchlorate | 1.5 | 1.5 | 1.5 |
| % copper phthalate hydrate | 0 | 2 | 5 |
| Max combustion temperature $T_c$ (K) | 1600 | 1600 | 1601 |
| Gas production $G_n$ moles/100 g | 2.85 | 2.76 | 2.63 |
| Gas production $G_v$ moles/100 cm$^3$ | 6.04 | 5.97 | 5.85 |
| Rb @ 21 MPa mm/sec | 11.62 | 10.81 | 12.99 |
| Slope (n) | 0.348 | 0.338 | 0.316 |
| Constant (log a) | 0.028 | 0.028 | 0.014 |
| Density | 2.12 | 2.16 | 2.22 |

The results in Table 2 show that although the copper phthalate hydrate shows only a small increase in burning rate at the 5% level, it is still effective at reducing the pressure sensitivity of the burning rate. The gas yield at both the 2% and 5% level of copper phthalate in these gas generant formulations (Mixes 7 and 8) are acceptable for use in automotive airbag inflators.

In Table 3, a gas generant formulation as described in Mix 9 having copper phthalate hydrate at 2 weight % is measured sensitivity to temperature coefficient ($\sigma_P$) and a corresponding burning rate variability $\pi_k$ is calculated. The $\sigma_P$ is measured to be 0.11%/° C., while calculated burning rate variability $\pi_k$ is 0.15%/° C.

TABLE 3

| Component/Properties | Mix 9 |
|---|---|
| % bCN | 60.52 |
| % $GuNO_3$ | 18.98 |
| % Melamine monoxalate | 16.00 |
| % Copper phthalate hydrate | 2.00 |
| % $SiO_2$ slagging agent | 1.00 |
| % Ammonium perchlorate co-oxidizer | 1.50 |
| Max combustion temperature $T_c$ (K) | 1600 |
| Gas production $G_n$ moles/100 g | 2.45 |
| Density g/cm$^3$ | 2.37 |
| Gas production $G_v$ moles/100 cm$^3$ | 5.81 |
| Linear burn rate $R_b$ at 21 MPa mm/sec | 23.77 |
| Slope (n) | 0.254 |
| $\sigma_P$ %/° C. | 0.11 |
| $\pi_k$ %/° C. | 0.15 |

Example 2

Gas generants (designated Mixes 10-13) are tested that include another thermally stable crystalline hydrate compound having a water release temperature of greater than or equal to about 140° C., namely copper pyromellitate dihydrate, as shown in Table 4. The gas generants include basic copper nitrate (bCN) and guanidine nitrate ($GuNO_3$) as the main ingredients, along with a small percentage of ammonium perchlorate co-oxidizer, silicon dioxide ($SiO_2$) as a slagging agent.

TABLE 4

| Component/Properties | Mix 10 | Mix 11 | Mix 12 | Mix 13 |
|---|---|---|---|---|
| % bCN | 45.92 | 47.15 | 48.43 | 49.76 |
| % $GuNO_3$ | 48.58 | 44.35 | 40.07 | 35.74 |
| % Copper pyromellitate dihydrate | 3 | 6 | 9 | 12 |
| % $SiO_2$ slagging agent | 1 | 1 | 1 | 1 |
| % Ammonium perchlorate co-oxidizer | 1.5 | 1.5 | 1.5 | 1.5 |
| Max combustion temperature $T_c$ (K) | 1879 | 1847 | 1812 | 1774 |
| Gas production/yield $G_n$ moles/100 g | 2.9 | 2.8 | 2.7 | 2.59 |
| Gas production/yield $G_v$ moles/100 $cm^3$ | 5.84 | 5.79 | 5.72 | 5.66 |
| Linear burn rate $R_b$ at 21 MPa mm/sec | 13.5 | 14.4 | 15.4 | 16.6 |
| Slope (n) | 0.38 | 0.33 | 0.31 | 0.34 |
| Gas generant density (g/100 $cm^3$) | 2.01 | 2.07 | 2.12 | 2.19 |

The results in Table 4 show that copper pyromellitate dihydrate increases burning rate, generally reduces pressure sensitivity (n) of the burning rate (although as the amount increases in Mix 13, the pressure sensitivity somewhat increases), increases gas generant density, and reduces flame temperature of the formulation containing basic copper nitrate and guanidine nitrate as the main ingredients. Again, these are all advantageous in a gas generant formulation. Like the copper phthalate hydrate, when the copper pyromellitate dihydrate increases, both $G_n$ and $G_v$ (weight and volumetric measures of gas yield), is reduced, especially when copper pyromellitate dehydrate is present at levels above 10%. Again, an amount of copper pyromellitate dehydrate can be selected so that positive benefits will be realized, while maintaining an adequate gas yield.

Example 3

Further gas generants (designated Mixes 14-17) are tested that include yet another thermally stable crystalline hydrate compound having a water release temperature of greater than or equal to about 140° C., namely copper fumarate dihydrate, as shown in Table 5. The gas generants include basic copper nitrate (bCN) and guanidine nitrate ($GuNO_3$) as the main ingredients, along with a small percentage of ammonium perchlorate co-oxidizer, silicon dioxide ($SiO_2$) as a slagging agent.

TABLE 5

| Component/Properties | Mix 14 | Mix 15 | Mix 16 | Mix 17 |
|---|---|---|---|---|
| % bCN | 45.18 | 45.77 | 46.37 | 46.97 |
| % $GuNO_3$ | 49.32 | 45.73 | 42.13 | 38.53 |
| % Copper fumarate dihydrate | 3 | 6 | 9 | 12 |
| % $SiO_2$ slagging agent | 1 | 1 | 1 | 1 |
| % Ammonium perchlorate co-oxidizer | 1.5 | 1.5 | 1.5 | 1.5 |
| Max combustion temperature $T_c$ (K) | 1867 | 1821 | 1772 | 1723 |
| Gas production/yield $G_n$ moles/100 g | 2.94 | 2.87 | 2.79 | 2.72 |
| Gas production/yield $G_v$ moles/100 $cm^3$ | 5.87 | 5.84 | 5.8 | 5.77 |
| Linear burn rate $R_b$ at 21 MPa mm/sec | 14.7 | 15.6 | 15.6 | 16.4 |
| Slope (n) | 0.43 | 0.39 | 0.38 | 0.4 |
| Gas generant density (g/100 $cm^3$) | 2 | 2.04 | 2.08 | 2.12 |

The results in Table 5 show that copper fumarate dihydrate increases burning rate, reduces pressure sensitivity (n) of the burning rate, increases gas generant density, and reduces flame temperature of the formulation containing basic copper nitrate and guanidine nitrate as the main ingredients. The $G_n$ and $G_v$ (weight and volumetric measures of gas yield) are reduced, but even at 12% in Mix 17, the gas yields are still at acceptable levels for the gas generant.

Example 4

Gas generants (designated Mixes 18-21) are tested that include another thermally stable crystalline hydrate compound having a water release temperature of greater than or equal to about 140° C., namely copper (3-nitrophthalate) dihydrate, as shown in Table 6. The gas generants include basic copper nitrate (bCN) and guanidine nitrate ($GuNO_3$) as the main ingredients, along with a small percentage of silicon dioxide ($SiO_2$) as a slagging agent.

TABLE 6

| Component/Properties | Mix 18 | Mix 19 | Mix 20 | Mix 21 |
|---|---|---|---|---|
| % bCN | 46.0 | 47.7 | 49.5 | 51.3 |
| % $GuNO_3$ | 50.0 | 45.3 | 40.5 | 35.7 |
| % Copper(3-nitrophthalate) dihydrate | 3 | 6 | 9 | 12 |
| % $SiO_2$ slagging agent | 1 | 1 | 1 | 1 |
| Max combustion temperature $T_c$ (K) | 1843 | 1827 | 1812 | 1797 |
| Gas production/yield $G_n$ moles/100 g | 2.952 | 2.852 | 2.748 | 2.644 |
| Gas production/yield $G_v$ moles/100 $cm^3$ | 5.889 | 5.844 | 5.796 | 5.743 |
| Linear burn rate $R_b$ at 21 MPa mm/sec | 13.9 | 13.7 | 15.4 | 16.1 |
| Slope (n) | 0.42 | 0.40 | 0.37 | 0.34 |
| Gas generant density (g/100 $cm^3$) | 1.995 | 2.049 | 2.109 | 2.172 |

The results in Table 6 show that copper (3-nitrophthalate) dihydrate generally provides one or more of the following advantages (particularly at amounts greater than 6% by weight corresponding to Mixes 19-21): increased burning rate, reduced pressure sensitivity (n) of the burning rate, increased gas generant density, and/or reduced flame temperature of the formulation containing basic copper nitrate and guanidine nitrate as the main ingredients. Again, these are all advantageous in a gas generant formulation. Like the copper phthalate hydrate, when the copper (3-nitrophthalate) dihydrate increases, both $G_n$ and $G_v$ (weight and volumetric measures of gas yield), is reduced, especially when copper (3-nitrophthalate) dihydrate is present at levels above 10%. Thus, an amount of copper (3-nitrophthalate) dihydrate included in the gas generant composition can be selected so that positive benefits are realized, while maintaining an adequate gas yield.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A gas generant composition for an automotive inflatable restraint system comprising a fuel having a thermally stable crystalline hydrate compound with a water release temperature of greater than or equal to about 140° C. measured by differential scanning calorimetry (DSC) with a heating rate of 5° C./minute with a tolerance of ±0.1° C./minute, wherein the thermally stable crystalline hydrate compound is selected from the group consisting of: copper pyromellitate dihydrate, copper fumarate dihydrate, copper (3-nitrophthalate) dihydrate, and combinations thereof.

2. The gas generant composition of claim 1 having a sensitivity to temperature coefficient ($\sigma_P$) of less than or equal to about 0.2%/° C.

3. The gas generant composition of claim 1 having a burning rate variability $\pi_k$ of less than or equal to about 0.25%/° C.

4. The gas generant composition of claim 1 having a linear burn rate of greater than or equal to about 18 mm per second at a pressure of about 21 megapascals (MPa), a linear burn rate pressure exponent of less than or equal to about 0.35, a gas yield of greater than or equal to about 5.7 moles/100 $cm^3$, and a maximum flame temperature at combustion ($T_c$) of less than or equal to about 1700K (1,427° C.).

5. The gas generant composition of claim 1, wherein the thermally stable crystalline hydrate compound is present at greater than 0% to less than or equal to about 12% by weight of the total gas generant composition.

6. The gas generant composition of claim 5, wherein the fuel is a first fuel and the gas generant composition comprises one or more additional fuels present at greater than or equal to about 10% to less than or equal to about 20% by weight of the total gas generant composition; one or more oxidizers are present at greater than or equal to about 30% to less than or equal to about 70% by weight of the total gas generant composition; and one or more gas generant additives are present at greater than or equal to 0% to less than or equal to about 10% by weight of the total gas generant composition.

7. The gas generant composition of claim 6, wherein:

the one or more additional fuels are selected from the group consisting of: guanidine nitrate, diammonium 5,5'-bitetrazole (DABT), copper bis guanylurea dinitrate, hexamine cobalt (III) nitrate, copper diammine bitetrazole, a melamine oxalate compound, and combinations thereof, the one or more oxidizers are selected from the group consisting of: basic copper nitrate, alkali metal or alkaline earth metal nitrates, alkali metal, alkaline earth metal, or ammonium perchlorates, metal oxides, and combinations thereof; and the one or more gas generant additives are selected from the group consisting of: silicon dioxide, aluminum oxide, and combinations thereof.

8. The gas generant composition of claim 1, wherein the fuel having the thermally stable crystalline hydrate compound is a first fuel present at greater than 0% to less than or equal to about 12% by weight of the total gas generant composition and the gas generant composition further comprises:

guanidine nitrate present as a second fuel at greater than or equal to about 15% to less than or equal to about 50% by weight of the total gas generant composition;

a third fuel present at greater than or equal to 0% to less than or equal to about 20% by weight of the total gas generant composition;

basic copper nitrate present at greater than or equal to about 30% to less than or equal to about 70% by weight of the total gas generant composition; and one or more slagging agents present at greater than or equal to 0% to less than or equal to about 5% by weight of the total gas generant composition.

9. The gas generant composition of claim 8, wherein the third fuel comprises a melamine oxalate compound.

10. A gas generant composition for an automotive inflatable restraint system comprising a copper phthalate monohydrate compound represented by the structure

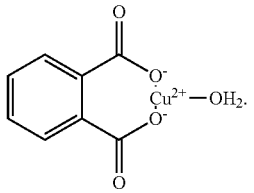

11. The gas generant composition of claim 10 having a sensitivity to temperature coefficient ($\sigma_P$) of less than or equal to about 0.2%/° C. and a burning rate variability $\pi_k$ of less than or equal to about 0.25%/° C.

12. The gas generant composition of claim 10 having a linear burn rate of greater than or equal to about 18 mm per second at a pressure of about 21 megapascals (MPa), a linear burn rate pressure exponent of less than or equal to about 0.35, a gas yield of greater than or equal to about 5.7 moles/100 $cm^3$, and a maximum flame temperature at combustion ($T_c$) of less than or equal to about 1700K (1,427° C.).

13. The gas generant composition of claim 10, wherein the copper phthalate monohydrate compound is present at greater than 0% to less than or equal to about 10% by weight of the total gas generant composition.

14. The gas generant composition of claim 13 further comprising one or more fuels present at greater than or equal to about 10% to less than or equal to about 20% by weight of the total gas generant composition; one or more oxidizers are present at greater than or equal to about 30% to less than or equal to about 70% by weight of the total gas generant composition; and one or more gas generant additives are present at greater than or equal to 0% to less than or equal to about 10% by weight of the total gas generant composition.

15. The gas generant composition of claim 14, wherein:

the one or more fuels are selected from the group consisting of: guanidine nitrate, diammonium 5,5'-bitetrazole (DABT), copper bis guanylurea dinitrate, hexamine cobalt (III) nitrate, copper diammine bitetrazole, a melamine oxalate compound, and combinations thereof, the one or more oxidizers are selected from the group consisting of: basic copper nitrate, alkali metal or alkaline earth metal nitrates, alkali metal, alkaline earth metal, or ammonium perchlorates, metal oxides, and combinations thereof; and the one or more gas generant additives are selected from the group consisting of: silicon dioxide, aluminum oxide, and combinations thereof.

16. The gas generant composition of claim 10, wherein the copper phthalate monohydrate compound is a first fuel present at greater than 0% to less than or equal to about 10% by weight of the total gas generant composition and the gas generant composition further comprises:

guanidine nitrate is a second fuel present at greater than or equal to about 15% to less than or equal to about 50% by weight of the total gas generant composition;

a third fuel present at greater than or equal to 0% to less than or equal to about 20% by weight of the total gas generant composition;

basic copper nitrate present at greater than or equal to about 30% to less than or equal to about 70% by weight of the total gas generant composition; and one or more slagging agents present at greater than or equal to 0% to less than or equal to about 5% by weight of the total gas generant composition.

17. The gas generant composition of claim 16, wherein the third fuel comprises a melamine oxalate compound.

18. A cool burning gas generant composition for an automotive inflatable restraint system comprising a copper phthalate monohydrate compound represented by the structure

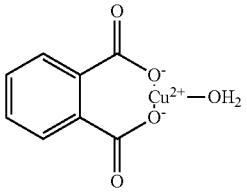

having a maximum flame temperature at combustion ($T_c$) of less than or equal to about 1700K (1,427° C.), a sensitivity to temperature coefficient ($\sigma_P$) of less than or equal to about 0.2%/° C. and a burning rate variability $\pi_k$ of less than or equal to about 0.25%/° C.

19. The cool burning gas generant composition of claim 18, wherein the copper phthalate monohydrate compound is a first fuel present at greater than 0% to less than or equal to about 10% by weight of the total gas generant composition and the cool burning gas generant composition further comprises:

guanidine nitrate is a second fuel present at greater than or equal to about 15% to less than or equal to about 50% by weight of the total gas generant composition;

a melamine oxalate compound is a third fuel present at greater than or equal to 0% to less than or equal to about 20% by weight of the total gas generant composition;

basic copper nitrate present at greater than or equal to about 30% to less than or equal to about 70% by weight of the total gas generant composition; and one or more slagging agents present at greater than or equal to 0% to less than or equal to about 5% by weight of the total gas generant composition.

* * * * *